US006312250B1

(12) United States Patent
Neville et al.

(10) Patent No.: US 6,312,250 B1
(45) Date of Patent: Nov. 6, 2001

(54) PREMIX BURNER WITH FIRING RATE CONTROL

(75) Inventors: Thomas B. Neville; Brian J. Schmotzer, both of Cleveland Hts.; Naim H. Saker, Strongsville, all of OH (US)

(73) Assignee: North American Manufacturing Company, Cleveland, OH (US)

( * ) Notice: Subject to any disclaimer, the term of this patent is extended or adjusted under 35 U.S.C. 154(b) by 0 days.

(21) Appl. No.: 09/522,060

(22) Filed: Mar. 9, 2000

Related U.S. Application Data

(60) Provisional application No. 60/130,006, filed on Apr. 19, 1999.

(51) Int. Cl.[7] ..... F23D 14/60

(52) U.S. Cl. ..... 431/1; 431/12; 431/60; 431/285; 239/415

(58) Field of Search ..... 431/1, 12, 6, 60, 431/61, 89, 174, 177, 181, 285; 239/412, 415

(56) References Cited

U.S. PATENT DOCUMENTS

| | | | | |
|---|---|---|---|---|
| 3,288,199 | * | 11/1966 | Gerrard et al. | 431/12 |
| 4,059,385 | * | 11/1977 | Gulitz et al. | 431/12 |
| 4,482,313 | | 11/1984 | Cheetham . | |
| 4,793,798 | | 12/1988 | Sabin . | |
| 4,913,647 | * | 4/1990 | Bonne et al. | 431/12 |
| 5,407,345 | | 4/1995 | Robertson et al. . | |
| 5,522,721 | * | 6/1996 | Drogue et al. | 431/1 |
| 5,554,021 | | 9/1996 | Robertson et al. . | |
| 5,660,542 | * | 8/1997 | Rinker et al. | 431/12 |
| 5,667,376 | | 9/1997 | Robertson et al. . | |
| 5,685,707 | | 11/1997 | Ramsdell et al. . | |
| 5,713,206 | | 2/1998 | McWhirter et al. . | |
| 5,730,591 | | 3/1998 | Robertson et al. . | |
| 5,879,148 | | 3/1999 | Cheng et al. . | |

FOREIGN PATENT DOCUMENTS

| | | | | |
|---|---|---|---|---|
| 23 37 517 A | | 2/1975 | (DE) . | |
| 197 28 965 A | | 1/1998 | (DE) . | |
| 0 509 882 A | | 10/1992 | (EP) . | |
| 0 866 270 A | | 9/1998 | (EP) . | |
| 1149389A | | 4/1969 | (GB) . | |
| 05 296447 A | | 11/1993 | (JP) . | |
| 6 918 316 A | | 6/1971 | (NL) . | |
| 989251 | * | 1/1983 | (SU) | 431/12 |

OTHER PUBLICATIONS

International Search Report of Application No. PCT/US00/10293 dated Nov. 8, 2000.

* cited by examiner

*Primary Examiner*—Sara Clarke
(74) *Attorney, Agent, or Firm*—Jones, Day, Reavis & Pogue

(57) ABSTRACT

A premix burner apparatus includes a burner structure and a firing rate control system. The burner structure defines a premix reaction zone configured to communicate with a process chamber. The burner structure further defines a plurality of separate entrances to the reaction zone, and a corresponding plurality of separate premix flow paths, each of which is configured to direct both oxidant and fuel to a respective one of the entrances to the reaction zone. The firing rate control system is operative to control flows of oxidant and fuel along at least one of the flow paths separately from flows of oxidant and fuel along at least one other flow path.

14 Claims, 8 Drawing Sheets

PREMIX BURNER WITH FIRING RATE CONTROL

This application claims the benefit under 35 USC §119 of provisional patent application Serial No. 60/130,006, filed Apr. 19, 1999.

FIELD OF THE INVENTION

The present invention relates to a burner apparatus having a reaction zone in which a premix of fuel and oxidant is ignited and undergoes combustion to heat a process chamber communicating with the reaction zone.

BACKGROUND OF THE INVENTION

A premix burner is part of an industrial furnace having a process chamber in which a drying or heating process is performed. The burner has a reaction zone communicating with the process chamber. A mixture of fuel and oxidant, which is known as a premix, is ignited and burned in the reaction zone to provide thermal energy for heating the process chamber. The premix is formed upon intermixing of the fuel and oxidant along flow paths that convey the fuel and oxidant to the reaction zone.

The combustion conditions in the reaction zone can be controlled by controlling the firing rate at which the premix is ignited upon entering the reaction zone. The firing rate is generally controlled by modulating the velocity at which the premix enters the reaction zone. The velocity is modulated uniformly throughout all of the premix flow paths leading to the reaction zone.

Modulating the premix flow velocity has certain limitations as a way to control the firing rate of the burner. First, the practical velocity turn-down range is limited by flashback. Flashback occurs when premix flow velocity decreases sufficiently to allow flame to propagate upstream along the flow paths leading to the reaction zone. Second, ultra low NOx emissions, and to some extent very low CO emissions, depend on excellent mixing of the fuel and oxidant forming the premix. Unfortunately, mixing quality can deteriorate as the flow path velocity and pressure drop decrease when the burner is turned down in a conventional manner.

Additionally, premix burners can amplify or cancel noise, depending in part on the velocity at which the premix flows toward and into the reaction chamber. The burner can be tuned for noise accordingly, but conventional turn-down changes the premix velocity and thus changes the noise tuning of the burner. This limits the velocity turn-down range for some noise-prone applications. The minimum velocity may thus be limited by flashback, emissions levels, and noise tuning limits.

Increasing the maximum velocity in a premix burner is one way to increase the turn-down range. Increasing the maximum velocity and reducing the size of the burner increases the turn-down range by increasing the amount of turn-up. However, increasing the turn-down range with a higher maximum velocity can significantly increase pressure requirements and, therefore, power costs. Accordingly, increasing the maximum premix flow velocity can be an expensive way to increase the turn-down range.

Conventional control of the burner firing rate can also be rather slow. The transition from a low to a high firing rate may take from thirty seconds to several minutes, depending on the speed of the fuel and oxidant control devices, and also on the ability of the ratio control system to maintain the fuel to oxidant ratio. Many low NOx burners require precise ratio control that can be maintained adequately only when the firing rate is changed slowly. This might not be suitable for applications that require a rapid firing rate response for optimum performance.

SUMMARY OF THE INVENTION

In accordance with the invention, a premix burner apparatus includes a burner structure and a firing rate control system. The burner structure defines a premix reaction zone configured to communicate with a process chamber. The burner structure further defines a plurality of separate entrances to the reaction zone, and a corresponding plurality of separate premix flow paths, each of which is configured to direct both oxidant and fuel to a respective one of the entrances to the reaction zone. The control system is operative to control flows of oxidant and fuel along at least one of the flow paths separately from flows of oxidant and fuel along at least one other flow path.

In a preferred embodiment of the invention, the control system is operative to interrupt flows of oxidant and fuel along at least one of the flow paths while oxidant and fuel continue to flow along at least one other flow path. The control system includes a plurality of separately shiftable valve assemblies. Each valve assembly has a closed condition blocking a combined flow of oxidant and fuel along a single corresponding one of the flow paths, and has an open condition not blocking that flow.

The invention enables the firing rate to be controlled precisely and rapidly at the entrances to the reaction zone because the flow paths conveying premix to the entrances are controlled separately from each other. Since the firing rate can be affected by affecting the premix flow at one or more of the entrances to the reaction zone, the premix velocity and the fuel to oxidant ratio can remain substantially constant at the other entrances to the reaction zone.

In accordance with another principal feature of the invention, the firing rate control system further includes a controller which is operative to cause a shift of one or more of the valve assemblies between their open and closed conditions, and thereby to switch the corresponding premix flows ON and OFF. This type of on-off control can be practiced in a number of different modes, including modes in which premix flows are cycled ON and OFF for sustained control of the burner firing rate, and modes in which premix flows are turned ON and OFF for turn-up and turn-down of the burner firing rate.

Another principal feature of the invention relates to a fuel supply system that conveys fuel from a fuel source to the burner structure. The fuel supply system includes a flow measuring device, a pressure regulating device and a valve. The pressure regulating device provides and maintains a selected value of fuel pressure between the flow measuring device and the burner structure. The valve provides and maintains a selected value of resistance to fuel flow between the flow measuring device and the burner structure. This configuration of fuel supply components enables the ratio of fuel to oxidant to remain substantially constant throughout on-off control of the premix flow paths. In a preferred embodiment of the invention, the values of fuel pressure and fuel flow resistance that are provided and maintained in the system are selected by a controller with reference to the fuel flow rate indicated by the flow measuring device.

DESCRIPTION OF PREFERRED EMBODIMENTS

Figure 1:
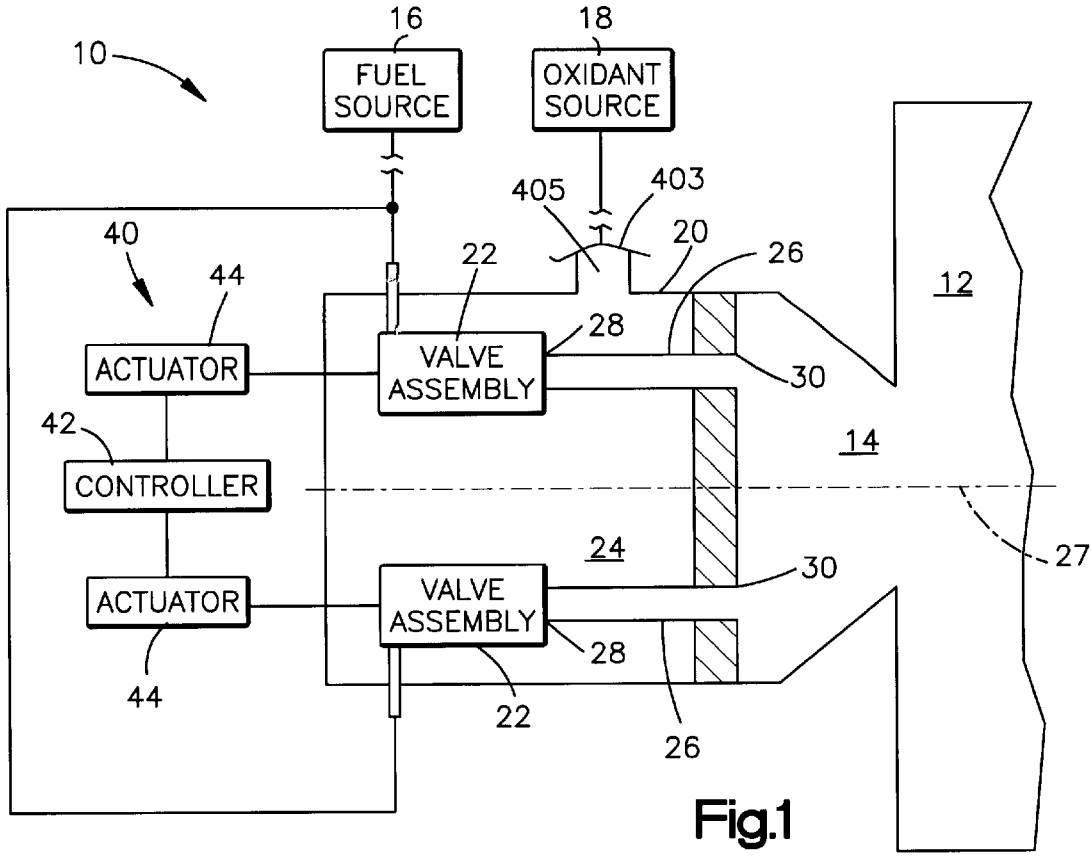
FIG. 1 is a schematic view of parts of an apparatus comprising a first embodiment of the invention.

A first embodiment of the invention is shown schematically in FIG. 1. The first embodiment includes a burner 10 which is part of an industrial furnace having a process chamber 12. A drying or other heating process is performed on a load (not shown) in the chamber 12. Thermal energy for the heating process is generated in a reaction zone 14 in the burner 10. This occurs upon combustion of a fuel and oxidant mixture in the reaction zone 14. Specifically, the burner 10 of FIG. 1 is a premix burner in which fuel from a fuel source 16 is mixed with oxidant from an oxidant source 18 to form a premix. The premix is ignited and undergoes combustion in the reaction zone 14 to provide thermal energy to the adjoining process chamber 12.

The parts of the burner 10 that are shown in FIG. 1 include a housing structure 20 and a plurality of valve assemblies 22. An oxidant supply plenum 24 is defined within the housing structure 20. Six mixer tubes 26, two of which are shown in FIG. 1, are arranged in the plenum 24 in a cylindrical array centered on an axis 27. The inner ends 28 of the mixer tubes 26 are located within the plenum 24. The outer ends 30 of the mixer tubes 26 define respective entrances to the reaction zone 14.

The valve assemblies 22 are operative to provide controlled flows of oxidant and fuel along the mixer tubes 26. All of the valve assemblies 22 in this embodiment are located within the plenum 24 so as to receive a common supply of oxidant from the oxidant source 18. Each valve assembly 22 receives a supply of fuel from the fuel source 16 separately from each other valve assembly 22. Moreover, each valve assembly 22 is operatively engaged with the inner end 28 of a single corresponding mixer tube 26. In this arrangement, each valve assembly 22 is operative to provide the corresponding mixer tube 26 with controlled flows of oxidant and fuel separately from the controlled flows of oxidant and fuel in any other mixer tube 26.

As further shown schematically in FIG. 1, the valve assemblies 22 are included in a firing rate control system 40 with a controller 42 and a corresponding plurality of actuators 44. The valve assemblies 22 in the first embodiment of the invention, as well as the actuators 44, are alike and have the configuration shown by way of example in FIG. 2. The mixer tubes 26 in the first embodiment also are alike. Each has a cylindrical configuration with a longitudinal central axis 49, as shown partially in FIG. 2. The inner end 28 of the mixer tube 26 is preferably flared radially outward in a generally bell-shaped configuration.

Figure 2:
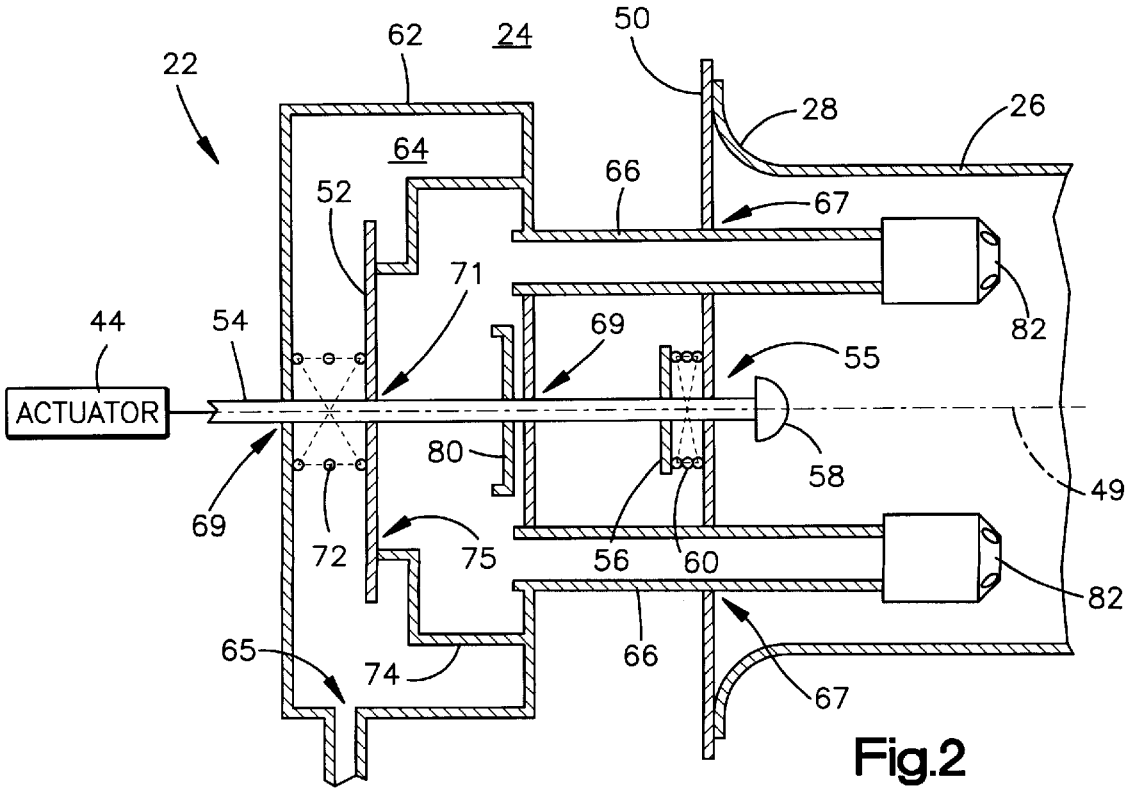
FIG. 2 is an enlarged partial view of parts shown in FIG. 1.
Figure 3:
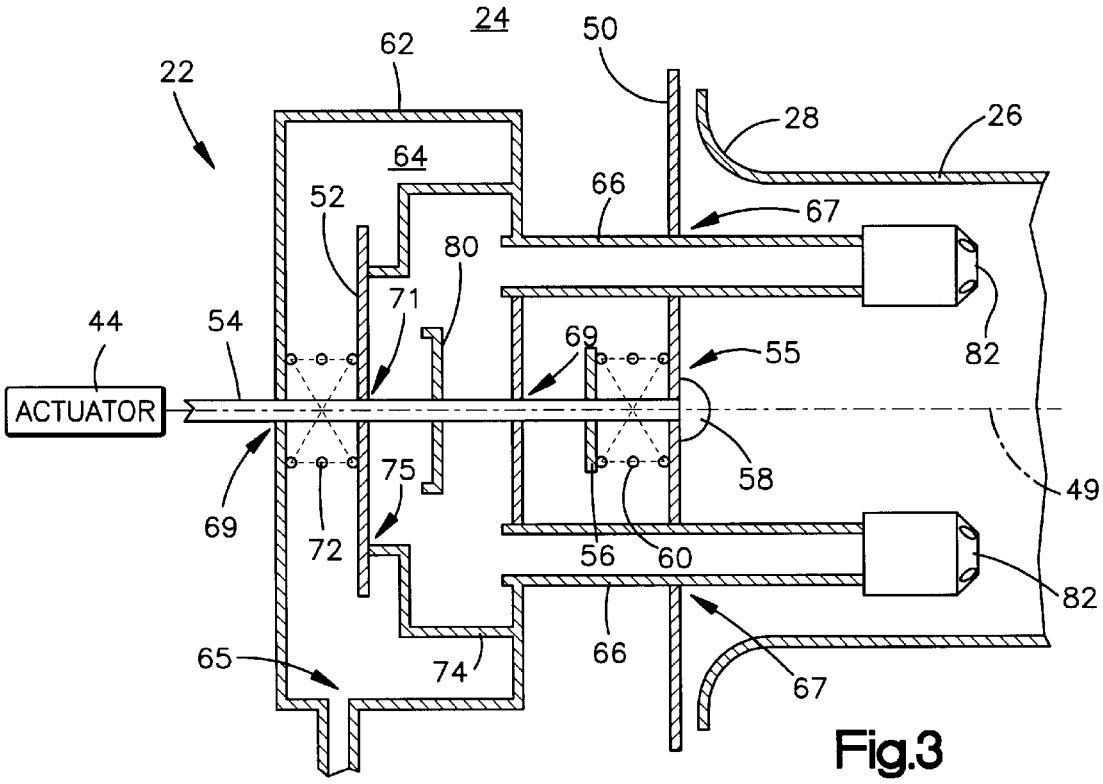
FIGS. 3 and 4 are views similar to FIG. 2 showing parts in different positions.
Figure 4:
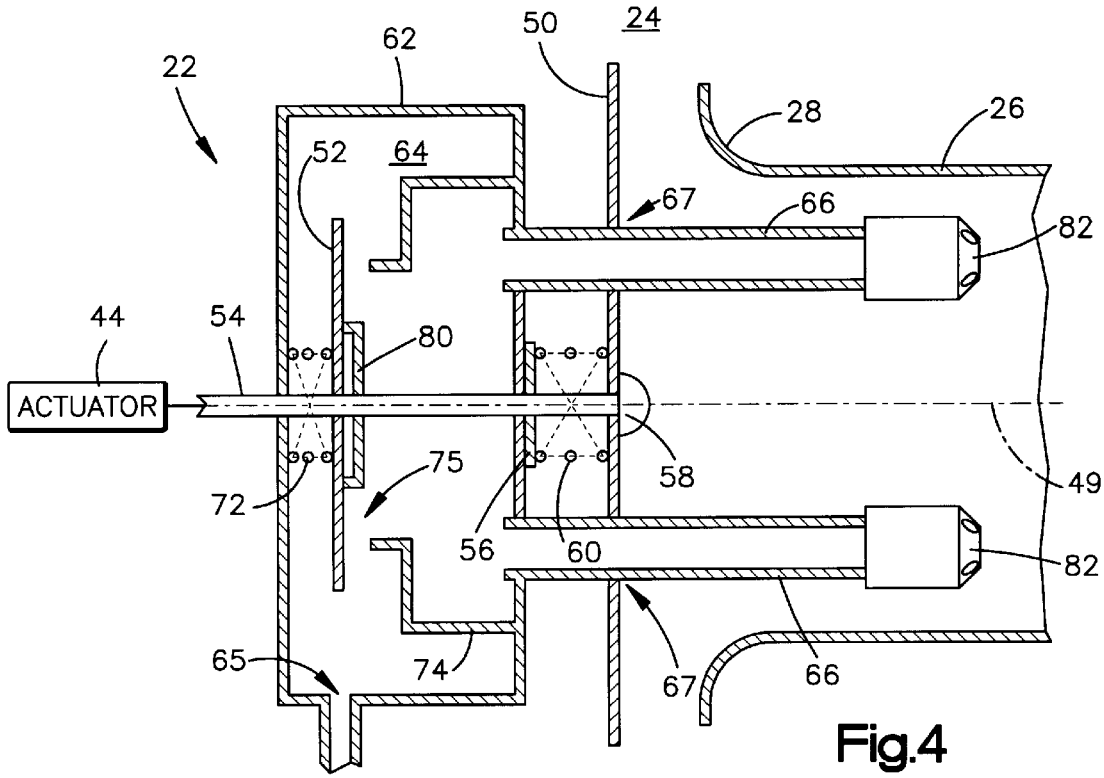

The valve assembly 22 includes a first movable valve plate 50, a second movable valve plate 52, and a control rod 54. The actuator 44 moves the control rod 54 back and forth along the axis 49. The control rod 54 interacts with the valve plates 50 and 52 to move them back and forth between the positions in which they are shown in FIGS. 2, 3 and 4. Each actuator 44 is thus operative to shift the corresponding valve assembly 22 throughout a range of conditions. These include a fully closed condition, as shown in FIG. 2, a partially open condition, as shown for example in FIG. 3, and a fully open condition, as shown in FIG. 4.

The control rod 54 extends closely through an aperture 55 at the center of the first valve plate 50. The aperture 55 permits sliding movement of the first valve plate 50 axially between a pair of stop members 56 and 58 that are fixed to the rod 54. A first spring 60 is compressed axially between the first valve plate 50 and the first stop member 56.

The second valve plate 52 is located within a housing portion 62 of the valve assembly 22. The housing 62 defines a fuel supply plenum 64 with an inlet 65 for receiving fuel from the fuel source 16 (FIG. 1). Three fuel injector tubes 66, two of which are shown in FIG. 2, project from the housing 62 into the mixer tube 26 through apertures 67 in the first valve plate 50. The control rod 54 extends through a pair of apertures 69 in the housing 62, and also through an aperture 71 at the center of the second valve plate 52.

When the valve assembly 22 is in the fully closed condition of FIG. 2, the first valve plate 50 abuts the inner end 28 of the mixer tube 26 to block the flow of oxidant from the oxidant supply plenum 24 into the mixer tube 26. The first spring 60 holds the first valve plate 50 firmly in that position. A second spring 72 holds the second valve plate 52 firmly against an inner housing structure 74. The second valve plate 52 then closes an opening 75 (best shown in FIG. 4) in the inner housing structure 74 to block the flow of fuel from the fuel supply plenum 64 to the injector tubes 66 through the opening 75.

The control rod 54 is moved axially from right to left, as viewed in the drawings, when the valve assembly 22 is shifted from the fully closed condition of FIG. 2 to the partially open condition of FIG. 3. The second stop member 58 at the end of the control rod 54 moves against the first valve plate 50 so as to draw the first valve plate 50 axially away from the end 28 of the mixer tube 26. This enables oxidant from the oxidant supply plenum 24 to flow into the mixed tube 26. However, the second valve plate 52 remains in its closed position while the control rod 54 slides axially through the aperture 71 until an opener 80 on the rod 54 moves against the second valve plate 52. The opener 80 then draws the second valve plate 52 axially away from the opening 75 against the bias of the second spring 72 upon movement of the control rod 54 fully to the position in which it is shown in FIG. 4. Fuel can then flow from the fuel supply plenum 64 to the injector tubes 66 through the opening 75, and further from the injector tubes 66 into the mixer tube 26 through nozzles 82 at the ends of the injector tubes 66.

Importantly, the first and second valve plates 50 and 52 in the first embodiment of the invention are linked together such that the partially open condition of FIG. 3 is interposed between the fully closed condition of FIG. 2 and the fully open condition of FIG. 4. This is a safety feature which ensures that the second valve plate 52 can be shifted from its closed position to an open position, and thereby to allow fuel to flow into the mixer tube 26, only when the first valve plate 50 is in an open position allowing oxidant also to flow into the mixer tube 26.

The burner 10 (FIG. 1) has a preferred mode of operation in which oxidant flows from the oxidant source 18 equally to all of the valve assemblies 22, and fuel flows from the fuel source 16 equally to all of the valve assemblies 22. The pressure of the oxidant flowing from the source 18 to the plenum 24 is controlled, as is the pressure of the fuel flowing from the source 16 to the plenums 64 (FIG. 2). Accordingly, when the valve assemblies 22 are all in their fully open conditions, a premix is formed in the mixer tubes 26, and the fuel to oxidant ratio of the premix is maintained at a substantially constant value corresponding to the pressures of the fuel and oxidant supplied to the plenums 24 and 64. The velocity of the premix emerging from the mixer tubes 26 also has a substantially constant value. The firing rate at the entrances 30 to the reaction zone 14 is likewise maintained at a substantially constant value as long as all of the valve assemblies 22 remain in their fully open conditions. However, in accordance with the invention, the control system 40 can vary the firing rate at the entrances 30 without substantially varying the velocity at which the premix enters the reaction zone 14.

The controller 42 (FIG. 1) operates the actuators 44 so as to shift the valve assemblies 22 between their open and closed conditions, and thereby to turn the corresponding mixer tubes 26 ON and OFF, for control of the burner firing rate in accordance with the invention. In the first embodiment of the invention, the controller 42 has a plurality of differing modes of operation. A first mode of operation comprises consecutive cycles in which a single valve assembly 22 is shifted back and forth between its fully open and fully closed conditions while the remainder of the valve assemblies 22 remain in their fully open conditions. Such shifting of a valve assembly 22 causes corresponding interruptions of the premix flow in the adjoining mixer tube 26. The same valve assembly 22 can be shifted in each cycle, but it may be desirable to shift a different one of the valve assemblies 22 in each cycle in order to prolong the working life of the actuators 44 and valve assemblies 22. Increasing the durations of the cycles also helps to prolong the working life of the actuators 44 and valve assemblies 22.

This method of on-off cycling varies the firing rate at the reaction zone entrances 30 by providing the entrances 30 with an effective premix flow area that differs from their total flow area potential. The effective premix flow area is equal to the average, over time, of the differing total flow areas that are utilized upon intermittent reduction of the number of mixer tubes 26 carrying premix to the entrances 30. This enables precise control of the firing rate because the effective premix flow area can have a fractional value that differs from the sum of any whole number of individual entrance flow areas.

Another mode of operation comprises shifting a selected group of valve assemblies 22 simultaneously. In the simplest form, this mode comprises shifting a selected group of valve assemblies 22 into or out of their fully closed conditions, and subsequently back to their previous conditions, while the remainder of the valve assemblies 22 remain in their fully open or closed conditions. The same or a different group of valve assemblies 22 can be shifted in consecutive cycles. A group of valve assemblies 22, or all of the valve assemblies 22, can likewise be shifted sequentially rather than simultaneously. Other modes of operation could differ in other ways, such as in the frequency or duration of cycles. In each case, the flows of premix emerging from any one or more of the mixer tubes 26 can be interrupted independently from each other, with each interruption providing a corresponding reduction in the firing rate of the burner 10.

On-off cycling of the mixer tubes 26 can be especially effective for combustion applications in which large thermal masses are heated in the process chamber 12. A large thermal mass may have a correspondingly long thermal time constant. Such a mass will be heated uniformly over time if its thermal time constant is long compared to the on-off cycle times. A smaller thermal mass also can be heated uniformly over time if the on-off cycle times are appropriately short.

Figure 5:
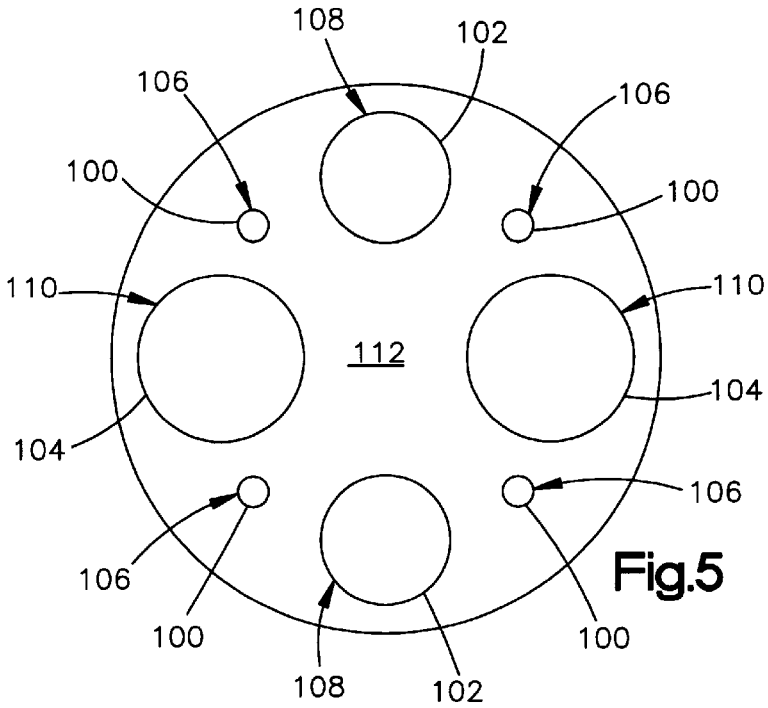
FIG. 5 is a partial view of an apparatus comprising a second embodiment of the invention.

As noted above, the mixer tubes 26 in the first embodiment of the invention are alike. As shown schematically in FIG. 5, a second embodiment of the invention includes differently sized mixer tubes 100, 102 and 104, with respective entrances 106, 108 and 110 to a reaction zone 112. These mixer tubes 100, 102 and 104 preferably have bell-shaped inner ends like the inner ends 28 described above, but otherwise have uniform diameters. When the flows of premix in the smallest mixer tubes 100 are cycled ON and OFF in accordance with the invention, the cycle to cycle variations in firing rate are smaller than those that occur upon corresponding on-off cycling at the larger mixer tubes 102 and/or 104. More precise control of the firing rate is possible with this embodiment of the invention because the differing sizes of the mixer tubes 100, 102 and 104 enable a greater number of effective premix flow area combinations to be achieved upon on-off cycling at the various mixer tubes 100, 102 and 104, by comparison to a plurality of mixer tubes of the same size.

Figure 6:
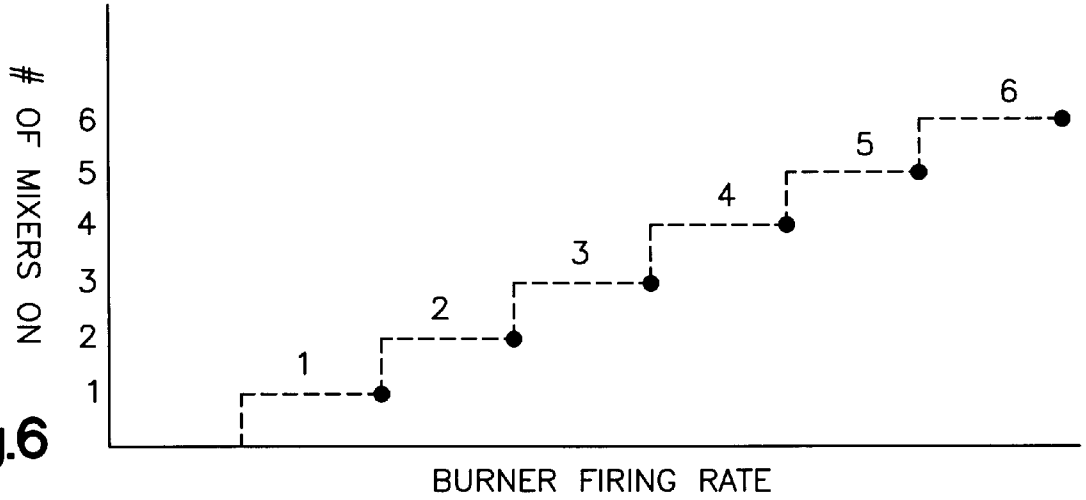
FIGS. 6 and 7 are graphs of performance characteristics of the first embodiment of the invention.
Figure 7:
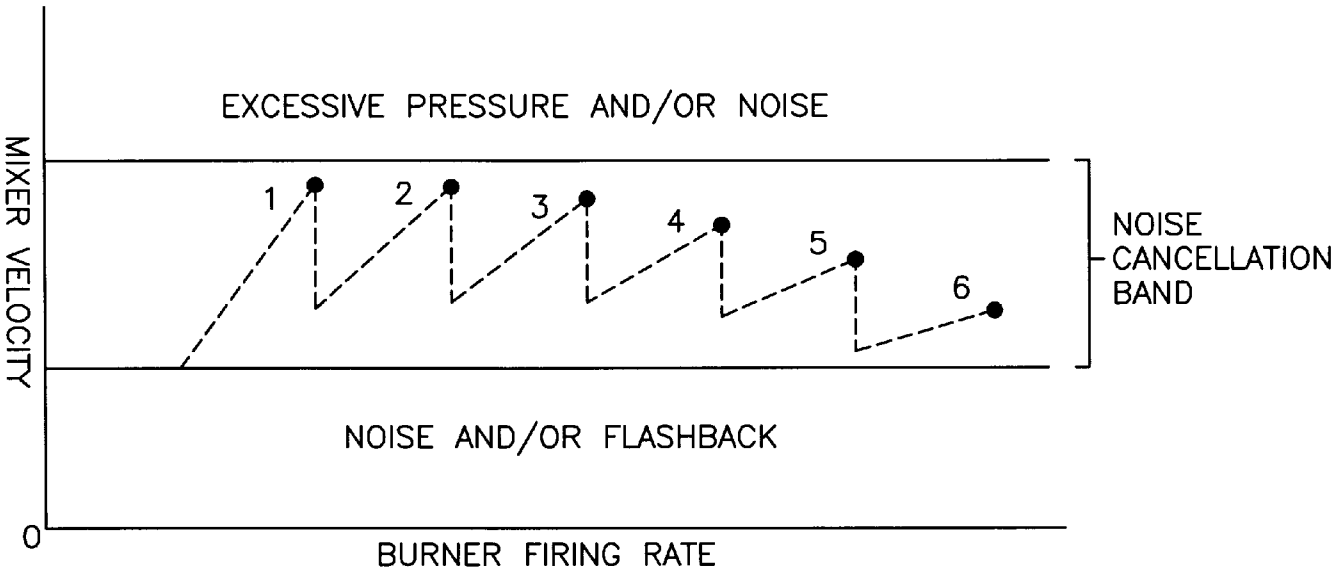

In addition to on-off cycling at the mixer tubes, the invention can be used for turn-down and turn-up of a burner without substantially varying the velocity at which the premix enters the reaction zone. This is indicated in FIGS. 6 and 7 with reference to a burner having six mixer tubes like the mixer tubes 26 in the first embodiment. In both figures the heavy black dots represent the operating conditions of the burner under an on-off control regime, while the dotted lines represent the operating conditions of the burner with on-off control of mixers as well as modulating control of the whole burner. In FIG. 6, turn-down of the burner firing rate is achieved each time a mixer tube is turned off, and turn-up is achieved each time a mixer tube is turned on. With only on-off control, this leads to only discrete points of firing rate that can be achieved. With the addition of modulating control, the other firing rates in between the discrete points can be achieved.

FIG. 7 shows a plot of mixer velocity versus burner firing rate. Under on-off control, the mixer velocity changes as mixers are turned on and off dependent on the characteristics of the oxidant supply system. In this example, the velocity increases as mixers are turned off and decreases as mixers are turned on, but only discrete values of firing rate and velocity are obtained. When modulating control is added, the velocity profile follows the dashed lines. As modulation is used to reduce the burner firing rate, the velocity decreases linearly, and when a mixer is turned off, the velocity increases at that firing rate.

The velocity can be held within a relatively narrow velocity band throughout most or all of the wide burner turn-down range because the turn-down is achieved by turning mixers OFF rather than by turning the velocity down. This can avoid changes in noise characteristics of the burner at different velocities. This can also curb the high-end pressure requirement of the burner at high velocities and avoid the propensity to flash back at low velocities.

Smoother and more continuous turn-down can further be achieved by using multiple mixer sizes. One or more smaller on-off mixers can be used in conjunction with one or more larger mixers, some or all of which may have on-off control. The smaller on-off mixers provide small turn-down steps to smooth the gaps between the larger steps of the larger on-off mixers. For example, six large mixers might each provide fifteen percent of the total burner input, and two smaller mixers might each provide only five percent of the total burner input. The burner could be turned up and down in five percent on-off steps through proper on-off switching of the mixers to meet the heat demand of the burner. This would provide relatively fine control of heat input for most applications. Combined with mixer cycling, any practical heating requirement can be met smoothly.

Even finer turn-down control can be obtained by using a wider range of smaller mixers. For example, in a variation of the second embodiment shown in FIG. 5, firing rate control in one percent increments can be achieved with nine mixers having the following size percentages: 1, 2, 2, 5, 10, 20, 20, 20, and 20.

In accordance with an additional feature of the invention, the speed of the on-off control at a mixer tube 26 is limited only by the speed at which the corresponding control rod 54 is moved by the actuator 44, which preferably comprises a fast acting solenoid or the like. Fast on-off control at each mixer tube 26 is a valuable characteristic for some processes that experience sudden changes in heat requirements. The fast on-off control may be combined with a supplementary burner system (not shown). Such a supplementary burner system would preferably comprise the apparatus described in copending U.S. patent application Ser. No. 60/126,472, filed Mar. 26, 1999, entitled A Premix Burner with Integral Mixers and Supplementary Burner System, which is incorporated herein by reference. A single fuel to oxidant ratio control system can be used to control fuel pressure and flow to the mixer tubes 26 and the supplementary burner system. In some cases it may be possible to operate the burner 10 at a low firing rate with only the supplementary burner system to maintain heat in the reaction zone 14, and then to shift to a higher firing rate in a few seconds by quickly shifting valve assemblies 22 open to turn the corresponding mixer tubes 26 on. The demand for a full firing rate can trigger a signal to the controller 44 to turn all or most of the mixer tubes 26 on simultaneously, or nearly simultaneously, in this manner. The burner 10 would then reach full input without any significant interruption of ignition because the supplementary burner system would anchor ignition and prevent any build up of unburned premix in the reaction zone 14 that could ignite in an undesirable way.

Figure 8:
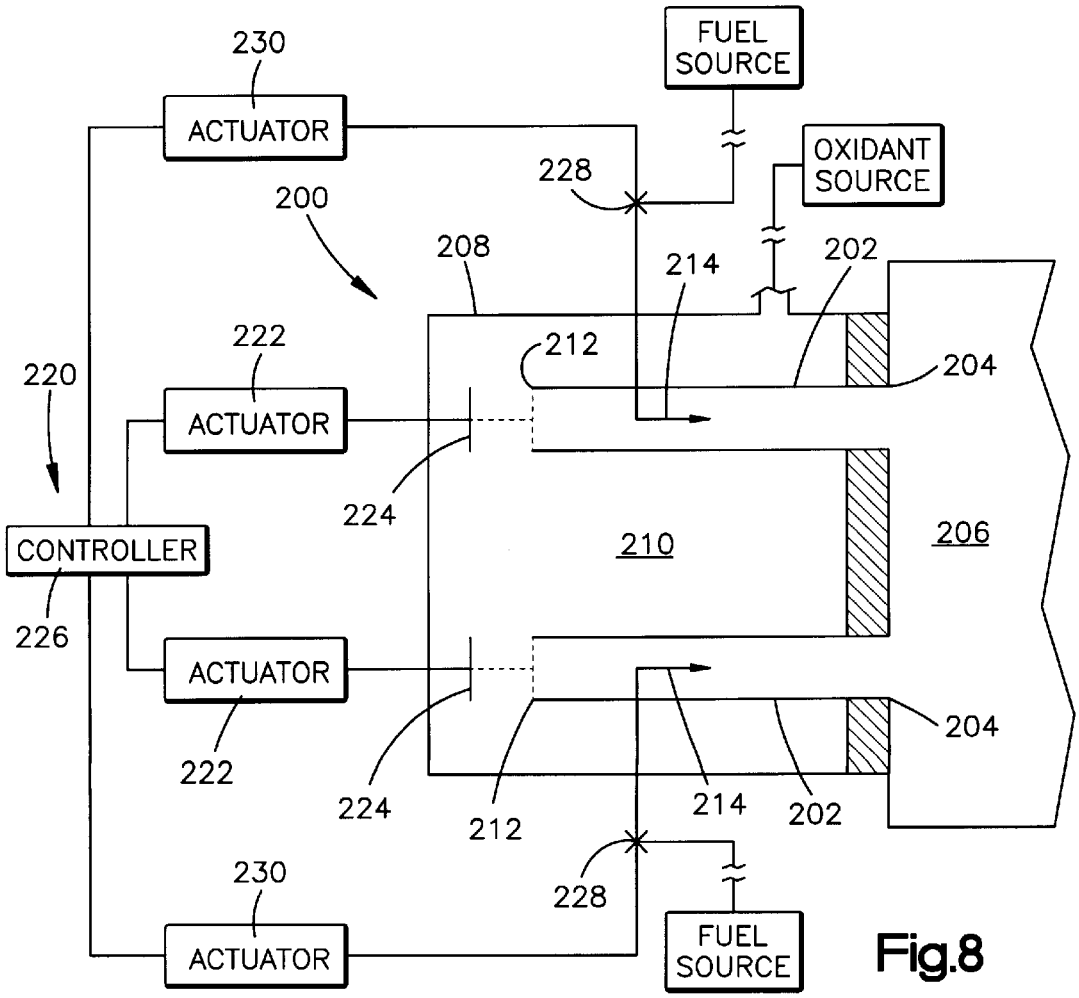
FIG. 8 is a schematic view of an apparatus comprising a third embodiment of the invention.

A burner 200 comprising a third embodiment of the invention is shown partially in the schematic view of FIG. 8. The burner 200 has mixer tubes 202 with entrances 204 to a reaction zone 206. The burner 200 further has a housing structure 208 defining an oxidant supply plenum 210 from which the mixer tubes 202 receive oxidant at their inner ends 212. Fuel is injected into the mixer tubes 202 by fuel injectors 214 that are located downstream of the inner ends 212.

Like the burner 10 described above, the burner 200 further has a control system 220 which is operative to control flows of oxidant and fuel along the mixer tubes 202 separately from each other. The control system 220 includes an actuator 222 and a valve member 224 for each mixer tube 202. The actuators 222 operate separately under the direction of a controller 226 to shift the valve members 224 into and out of closed positions in which they block flows of oxidant from the plenum 210 into the mixer tubes 202. A plurality of fuel control valves 228, and a corresponding plurality of actuators 230, also operate under the influence of the controller 226 in accordance with the invention, but are separate from the valve members 224. The control system 220 is otherwise operable to control the firing rate at the reaction zone entrances 204 by opening and closing the valves 224 and 228 in substantially the same manner as described above with reference to the control system 40. Additionally, the control system 220 is further operative to modulate the premix velocity and the fuel to oxidant ratio at each entrance 204, separately from each other entrance 204, by separately shifting the fuel control valves 228 throughout ranges of differing open conditions.

Figure 9:
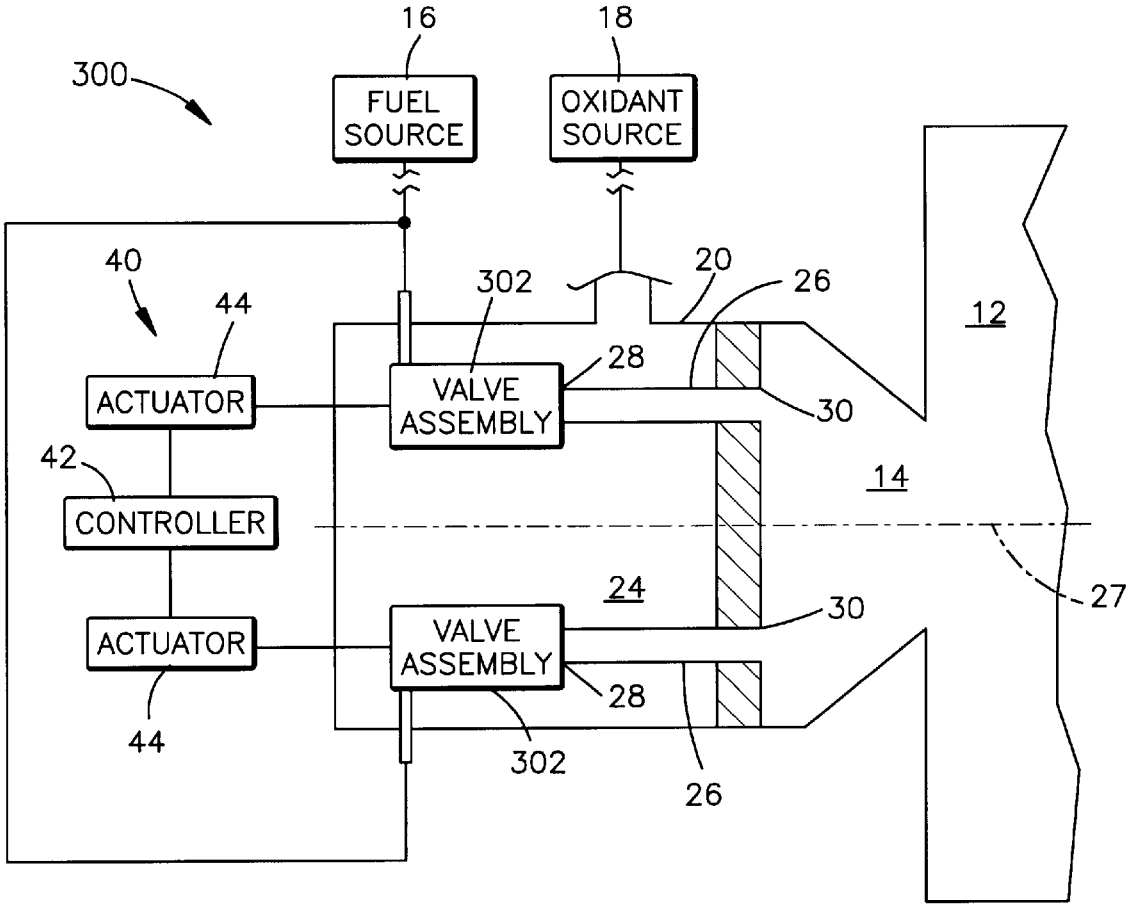
FIG. 9 is a schematic view of an apparatus comprising a fourth embodiment of the invention.

A fourth embodiment of the invention also uses modulating control in addition to on-off control in accordance with the invention. As shown in FIG. 9, the fourth embodiment is a burner 300 which includes many parts that are substantially the same as corresponding parts of the burner 10 described above. This is indicated by the use of the same reference numbers for such corresponding parts in FIGS. 1 and 9. However, the burner 300 includes alternative valve assemblies 302 in place of the valve assemblies 22 described above. Like each valve assembly 22, each valve assembly 302 is shiftable between open and closed conditions for on-off control of the corresponding mixer tube 26. Each valve assembly 302 is further shiftable between a range of intermediate conditions for modulating control of the mixer tube 26. The range of intermediate conditions of each valve assembly 22 provides a corresponding range of ratios at which fuel from the fuel source 16 and oxidant from the oxidant source 18 are together admitted to form a premix in the mixer tube 26. The actuators 44 are operative to shift the valve assemblies 302 separately from each other under the influence of the controller 42 so that the control system 40 provides a wide range of firing rate control at the reaction zone entrances 30 in accordance with the invention.

Figure 10:
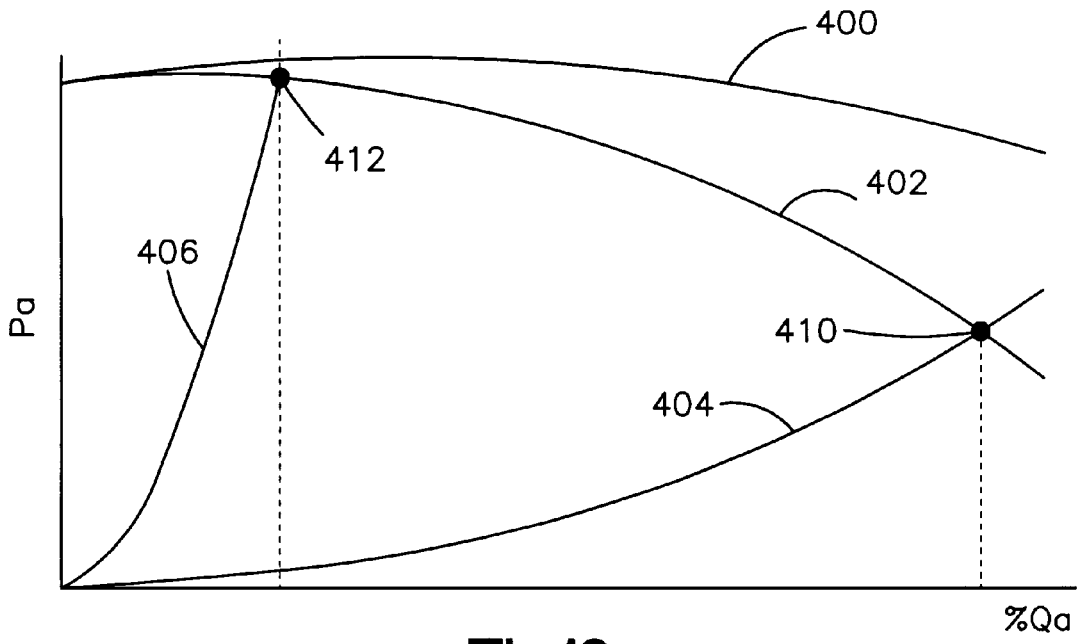
FIGS. 10 and 11 are graphs of performance characteristics of the first embodiment of the invention.
Figure 11:
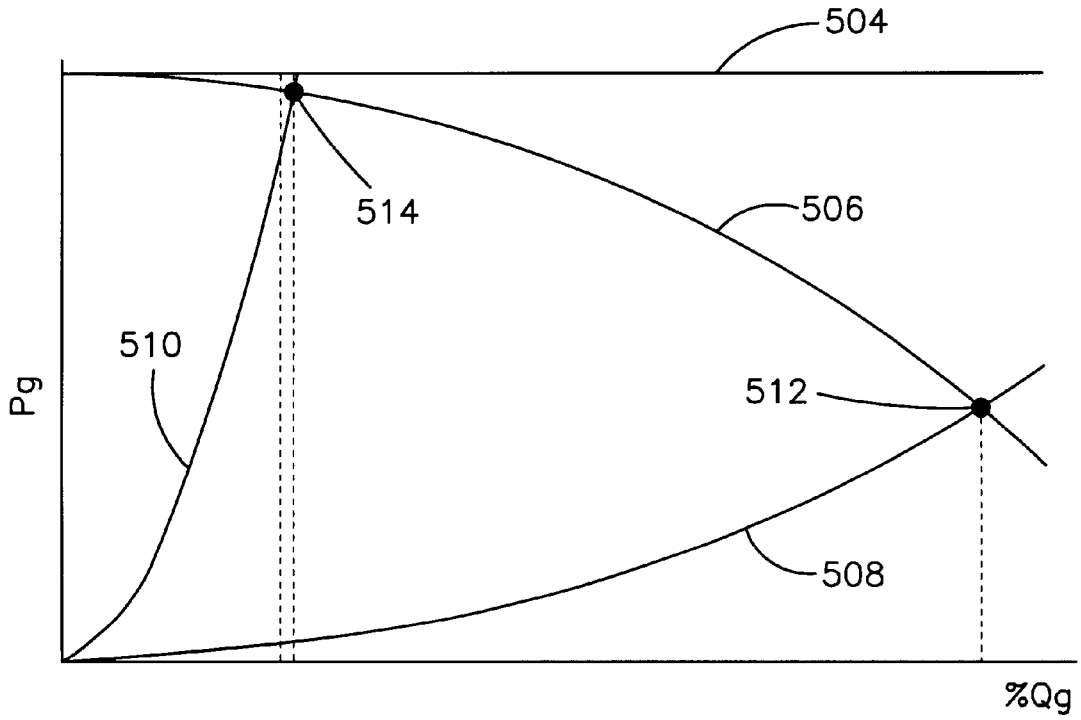

Additional on-off performance characteristics of the invention are shown in FIGS. 10 and 11. In the first embodiment of the invention described above, the oxidant source 18 (FIG. 1) is an air blower of known construction. The curve 400 of FIG. 10 is the blower curve. This curve 400 represents values of outlet pressure and flow rate for the particular blower 1 8. The curve 402 directly beneath the blower curve 400 is the air supply curve. This curve 402 represents values of pressure and air flow at the outlet 403 (FIG. 1) of the air supply system which communicates the blower 18 with the burner 10. The air supply curve 402 differs from the blower curve 400 because of resistance in the air supply system. This example of an air supply curve represents a particular constant value of that resistance.

The curve 404 of FIG. 10 is a burner resistance curve. This curve 404 represents values of pressure and air flow at the burner air inlet 405 (FIG. 1) when all of the six mixer tubes 26 are ON. A second burner resistance curve 406 represents values of pressure and air flow at the burner air inlet 405 when only one of the six mixer tubes 26 is ON. The second burner resistance curve 406 differs from the first burner resistance curve 404 because of the greater resistance to a given flow of air through the burner 10 along only a single mixer tube 26. Accordingly, the point 410 where the first burner resistance curve 404 intersects the air supply curve 402 represents the values of pressure and air flow at the burner air inlet 405 when all of the six mixer tubes 26 are ON. The point 412 where the second burner resistance curve 406 intersects the air supply curve 402 represents the values of pressure and air flow at the burner air inlet 405 when only one of the six mixer tubes 26 is ON.

In a similar manner, the curves of FIG. 11 represent values of pressure and flow for the fuel supplied to the mixer tubes 26 in the burner 10. The source 16 of fuel in the first embodiment of the invention is a utility supply of natural gas. As described below with reference to FIG. 12, a fuel supply system 500 conveys the gas from the source 16 to the burner 10. The fuel supply system 500 includes a pressure reducing regulator 502 which, as known in the art, provides and maintains a constant output pressure within a range of selectable output pressures. The horizontal line 504 of FIG. 11 represents the output pressure at the regulator 502. The curve 506 of FIG. 11 is a fuel supply curve. This curve 506 represents values of pressure and fuel flow at the outlet 507 of the fuel supply system 500. The fuel supply curve 506 differs from the regulator output line 504 because of resistance in the fuel supply system 500 between the regulator 502 and the burner 10. As with the air supply curve 402, this example of a fuel supply curve represents a particular constant value of resistance.

The curve 508 of FIG. 11 is a burner resistance curve. This curve 508 represents values of pressure and fuel flow at the burner fuel inlet 509 when all of the six mixer tubes 26 are ON. A second burner resistance curve 510 of FIG. 11 represents values of pressure and fuel flow at the burner fuel inlet 509 when only one of the six mixer tubes 26 is ON, and differs from the first burner resistance curve 508 because of the greater resistance to a given flow of fuel through the burner 10 along only a single mixer tube 26. The point 512 where the first burner resistance curve 508 intersects the fuel supply curve 506 represents the pressure and fuel flow at the burner fuel inlet 509 when all of the six mixer tubes 26 are ON. The graphs of FIGS. 10 and 11 are scaled such that the flow of fuel at the intersection point 512 (FIG. 11), as a relative percentage, coincides with the flow of air at the intersection point 410 (FIG. 10). This indicates that the burner 10 is operating at a specified fuel to oxidant ratio.

The second intersection point 514 of FIG. 11 represents values of pressure and fuel flow at the burner fuel inlet 509 when only one of the six mixer tubes 26 is ON. The second intersection point 514 of FIG. 11 does not coincide with the second intersection point 412 of FIG. 10. This is because the fuel supply curve 506 extends between the burner resistance curves 508 and 510 with a curvature that, because of inherent differences in device characteristics, differs from the curvature of the air supply curve 402 between the corresponding burner resistance curves 404 and 406. Accordingly, when all but one of the six mixer tubes 26 are turned OFF, the fuel flow decreases differently from the air flow. This changes the fuel to oxidant ratio. Such disruption of the fuel to oxidant ratio can be reduced by appropriate operation and control of the fuel supply system 500.

Figure 12:
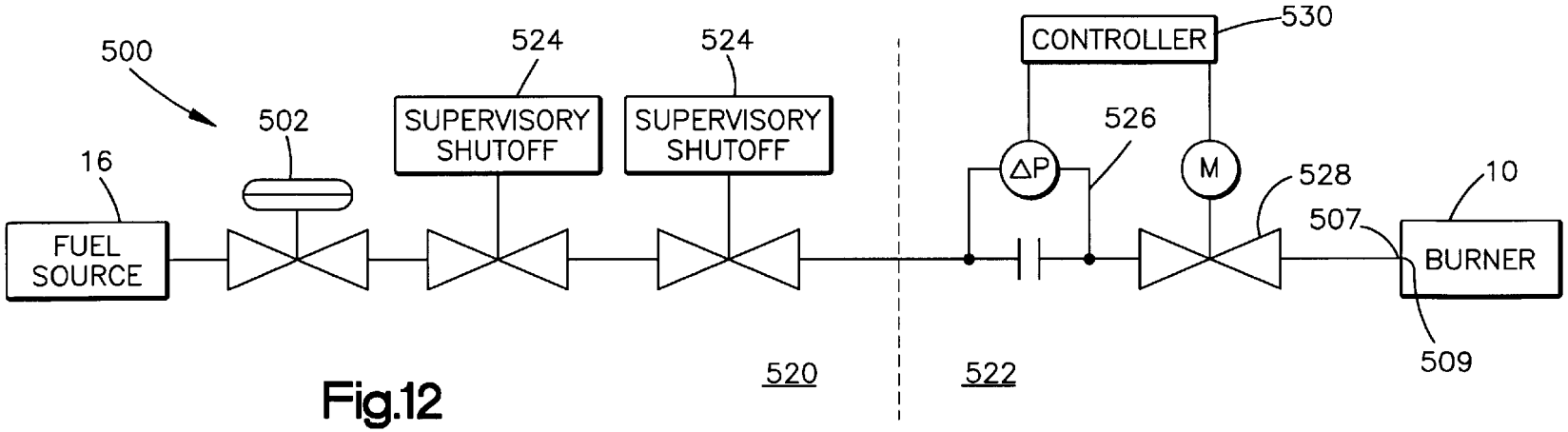
FIG. 12 is a schematic view of additional parts of the first embodiment of the invention.

Referring more specifically to FIG. 12, the fuel supply system 500 has two distinct portions 520 and 522 between the fuel source 16 and the burner 10. The first portion 520 of the fuel supply system 500 is a supervisory portion which includes at least a pair of supervisory shut-off valves 524 in series with the pressure reducing regulator 502. The second portion 522 of the fuel supply system 500 is a metering and flow control portion. That portion 522 of the fuel supply system 500 includes a flow measuring device 526 and a motorized control valve 528.

A controller 530 monitors the flow rate indicated by the measuring device 526, and compares it with a corresponding flow rate in the air supply system (not shown). A comparison of those flow rates may indicate a deviation from the specified fuel to oxidant ratio. If so, the controller 530 shifts the control valve 528, and may also shift a counterpart control valve in the air supply system, to direct the fuel and oxidant back toward the specified ratio.

Figure 14:
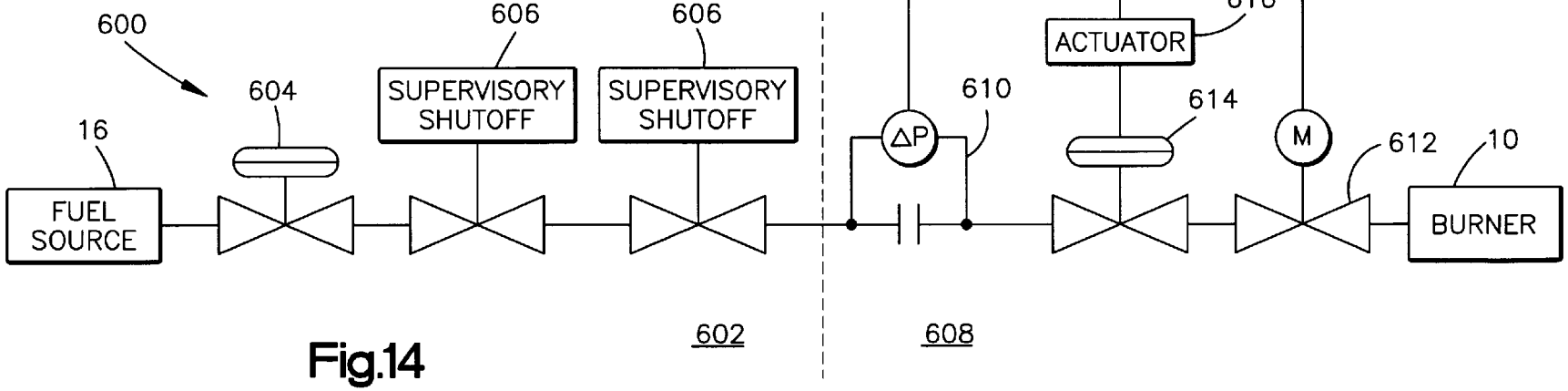
FIG. 14 is a view similar to FIG. 12 showing parts of an apparatus comprising a fifth embodiment of the invention.
Figure 13:
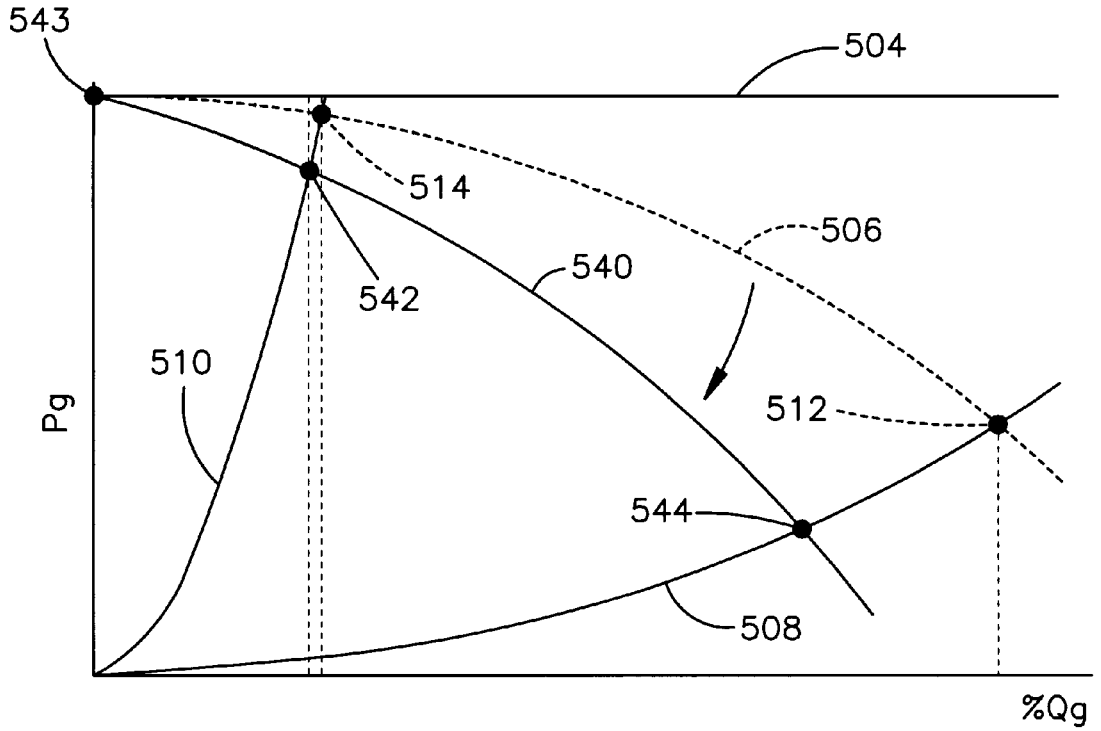
FIG. 13 is a graph of performance characteristics of the first embodiment of the invention.

When the controller 530 shifts the control valve 528 in the foregoing manner, it varies the flow resistance of the fuel supply system 500. This changes the fuel supply curve 506 of FIG. 11. The controller 530 thus provides a new fuel supply curve such as, for example, the fuel supply curve 540 of FIG. 13. As compared with the previous fuel supply curve 506, the new fuel supply curve 540 intersects the second burner resistance curve 510 at a point 542 that coincides with its counterpart 412 in FIG. 10. This indicates that the burner 10 will again operate at the specified fuel to oxidant ratio even though five of the six mixer tubes 26 have been turned off. However, when a fuel supply curve is changed upon shifting of the control valve 528, the constant output pressure of the regulator 502 constrains the curve to move only pivotally about the point 543 where the curve diverges from the regulator supply line 504. This causes the new fuel supply curve 540 to intersect the first burner resistance curve 508 at a point 544 that is spaced greatly from the original point 512 of intersection with that curve 508. Therefore, when the five mixer tubes 26 are turned back ON so that the burner 10 once again has all six mixer tubes 26 ON, the fuel flow at the new intersection point 544 will differ greatly from the fuel flow at the original intersection point 512. The ratio of fuel to oxidant will likewise differ from the specified ratio. This problem is avoided by operation of the alternative fuel supply system 600 of FIG. 14.

Figure 15:
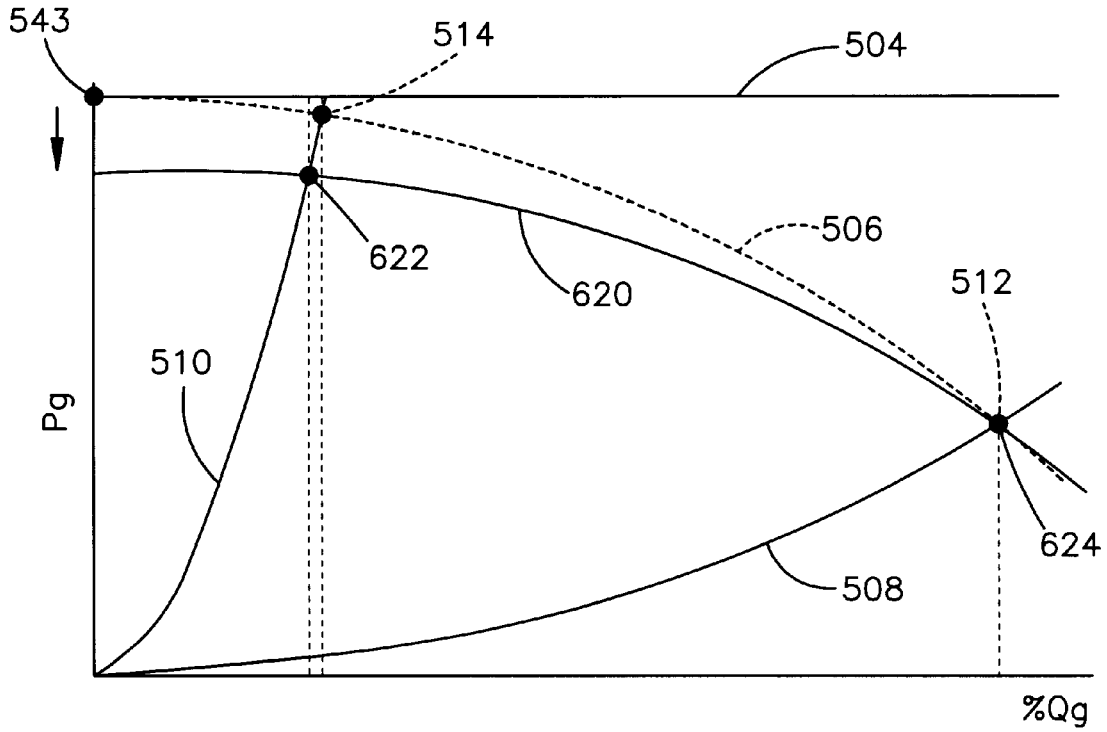
FIG. 15 is a graph of performance characteristics of the fifth embodiment of the invention.

The fuel supply system 600 has a supervisory portion 602 that includes a pressure reducing regulator 604 and redundant supervisory shut-off valves 606. Those parts 604 and 606 of the fuel supply system 600 are substantially the same as the corresponding parts of the fuel supply system 500. The fuel supply system 600 further has a metering and flow control portion 608 that differs from the corresponding portion 522 of the fuel supply system 500. Specifically, the fuel supply system 600 includes a flow measuring device 610 and a motorized control valve 612, and further includes a pressure regulating device such as, for example, a pressure regulator 614. Unlike the regulator 604, the regulator 614 is equipped with an actuator 616 which is operated by a controller 618. The regulator 614 and the control valve 612 operate in series to change the fuel supply curve differently from the manner in which the control valve 528 changes the fuel supply curve. This is indicated in FIG. 15, which shows a new fuel supply curve 620 that can be obtained by use of the regulator 614 and the control valve 612 in accordance with the invention.

The transition from the original fuel supply curve 506 to the new fuel supply curve 620 is accomplished in two phases. In one phase of transition, the controller 618 directs the actuator 616 to decrease the output pressure of the regulator 614. This causes the curve 506 to translate uniformly downward toward the horizontal axis of FIG. 15, and thereby to move to a location at which it intersects the second burner resistance curve 510 at a point 622 that coincides with the point 542 of FIG. 13. This ensures that the burner 10 will operate at the specified fuel to oxidant ratio when only one of the six mixer tubes 26 is ON. In the other phase of transition, the control valve 612 is shifted so as to vary the resistance between the regulator 614 and the burner 10, and thereby to move the curve 506 pivotally until it intersects the first burner resistance curve 508 at a point 624 that coincides with the point 512 of FIG. 13. This ensures that the burner 10 will operate at the specified fuel to oxidant ratio when all six of the mixer tubes 26 are ON. It may be necessary to perform these phases of curve transition in iterations, either sequentially or simultaneously, until satisfactory intersection points are reached. In each case, the regulator 614 and the control valve 612 are shifted until the controller 618 determines that the flow conditions indicated by the curves of FIG. 15 include the specified fuel to oxidant ratio when the mixer tubes 26 are turned OFF and ON in accordance with the present invention.

As described above, the fuel supply system 600 enables a fuel supply curve to translate vertically as well as to pivot, and thus enables a greater degree of equality to be achieved for the curvatures of a fuel supply curve and an oxidant supply curve. This enables the ratio of fuel to oxidant to be maintained with a correspondingly greater degree of precision for on-off control of a burner. Moreover, when an appropriate fuel supply curve has been established by practicing this feature of the invention, further iterations of curve transition may not be necessary to maintain a specified fuel to oxidant ratio during subsequent on-off control of the burner. It may thus be preferable for the motorized control valve 612 of FIG. 14, which shifts under the influence of the controller 618, to be replaced with a manually shiftable control valve. The manually shiftable control valve could be shifted to a condition in which the applied resistance imparts an appropriate pivotal orientation to the fuel supply curve, and could thereafter be allowed to remain in that condition.

The invention has been described with reference to preferred embodiments. Those skilled in the art will perceive improvements, changes and modifications. Such improvements, changes and modifications are intended to be within the scope of the claims.

What is claimed is:

1. A premix burner apparatus for heating a process chamber, said apparatus comprising:

a burner structure defining a premix reaction zone configured to communicate with the process chamber, said burner structure further defining a plurality of separate entrances to said reaction zone, and a corresponding plurality of separate premix flow paths, each of which is configured to direct both oxidant and fuel to a respective one of said separate entrances to said reaction zone; and a firing rate control system operative to control flows of oxidant and fuel along at least one of said flow paths separately from flows of oxidant and fuel along at least one other of said flow paths;

said firing rate control system being further operative to interrupt a combined flow of oxidant and fuel along at least one of said flow paths while oxidant and fuel continue to flow along at least one other of said flow paths;

said firing rate control system including a plurality of separately shiftable valve assemblies, each of which is shiftable between a closed condition blocking a combined flow of oxidant and fuel along a single corresponding one of said flow paths and an open condition not blocking said flow;

said firing rate control system further including a controller having a mode of operation comprising consecutive cycles in which said controller shifts only one of said valve assemblies into and out of its closed condition.

2. An apparatus as defined in claim 1 wherein a different one of said valve assemblies is shifted into and out of its closed condition in each of said consecutive cycles.

3. A premix burner apparatus for heating a process chamber, said apparatus comprising:

a burner structure defining a premix reaction zone configured to communicate with the process chamber, said burner structure further defining a plurality of separate entrances to said reaction zone, and a corresponding plurality of separate premix flow paths, each of which is configured to direct both oxidant and fuel to a respective one of said separate entrances to said reaction zone; and a firing rate control system operative to control flows of oxidant and fuel along at least one of said flow paths separately from flows of oxidant and fuel along at least one other of said flow paths;

said firing rate control system being further operative to interrupt a combined flow of oxidant and fuel along at least one of said flow paths while oxidant and fuel continue to flow along at least one other of said flow paths;

said firing rate control system including a plurality of separately shiftable valve assemblies, each of which is shiftable between a closed condition blocking a combined flow of oxidant and fuel along a single corresponding one of said flow paths and an open condition not blocking said flow;

said firing rate control system further including a controller operative to shift a selected plurality of said valve assemblies into their open or closed conditions sequentially.

4. A premix burner apparatus for heating a process chamber, said apparatus comprising:

a burner structure defining a premix reaction zone configured to communicate with the process chamber, said burner structure further defining a plurality of separate entrances to said reaction zone, and a corresponding plurality of separate premix flow paths, each of which is configured to direct both oxidant and fuel to a respective one of said separate entrances to said reaction zone; and a firing rate control system operative to control flows of oxidant and fuel along at least one of said flow paths separately from flows of oxidant and fuel along at least one other of said flow paths;

said burner structure including multiple mixer tubes, each of which extends along a respective one of said separate flow paths;

said burner structure further including an oxidant source and a housing structure defining an oxidant supply plenum commonly communicating said oxidant source with all of said mixer tubes;

said burner structure further including a fuel source and a plurality of additional housing structures defining fuel supply plenums separately communicating said fuel source with each of said mixer tubes.

5. A premix burner apparatus for providing premix to a reaction zone in which the premix is ignited and undergoes combustion to heat a process chamber communicating with the reaction zone, said apparatus comprising:

a mixer tube configured to receive oxidant and fuel and to release a premix of said oxidant and fuel to the reaction zone;

a first housing structure defining an oxidant supply plenum communicating with said mixer tube to supply said oxidant to said mixer tube;

a second housing structure defining a fuel supply plenum communicating with said mixer tube to supply said fuel to said mixer tube;

a first valve member actuatable between said mixer tube and said oxidant supply plenum so as to interrupt a flow of said oxidant from said oxidant supply plenum into said mixer tube;

a second valve member actuatable between said mixer tube and said fuel supply plenum so as to interrupt a flow of said fuel from said fuel supply plenum into said mixer tube; and an actuator assembly operable to shift said second valve member from a closed position to an open position only when said first valve member is in an open position.

6. An apparatus as defined in claim 5 wherein said actuator assembly includes a linkage interconnecting said first and second valve members such that said second valve member is shiftable from a closed position to an open position only when said first valve member is in an open position.

7. A method of operating a premix burner apparatus for heating a process chamber, the apparatus including a burner structure defining a premix reaction zone configured to communicate with the process chamber, the burner structure further defining a plurality of separate entrances to the reaction zone, and a corresponding plurality of separate premix flow paths, each of which is configured to direct both oxidant and fuel to a respective one of the separate entrances to the reaction zone, said method comprising:

controlling flows of oxidant and fuel along at least one of said flow paths separately from flows of oxidant and fuel along at least one other of said flow paths, said controlling step comprises interrupting combined flows of oxidant and fuel along a selected plurality of the flow paths sequentially.

8. A premix burner apparatus for heating a process chamber, said apparatus comprising:

a burner structure defining a premix reaction zone configured to communicate with the process chamber, said burner structure further defining a plurality of separate entrances to said reaction zone, and a corresponding plurality of separate premix flow paths, each of which is configured to direct both oxidant and fuel to a respective one of said entrances to said reaction zone; and a valve assembly operative to affect flows of oxidant and fuel along only a single one of said flow paths;

said valve assembly being shiftable between a closed condition blocking a combined flow of oxidant and fuel along said single flow path, and an open condition not blocking said flow;

said valve assembly being further shiftable to a partially open condition blocking a flow of fuel along said single flow path but not blocking a flow of oxidant along said single flow path.

9. A premix burner apparatus for heating a process chamber, said apparatus comprising:

a burner structure defining a premix reaction zone configured to communicate with the process chamber, said burner structure further defining a plurality of separate entrances to said reaction zone, and a corresponding plurality of separate premix flow paths, each of which is configured to direct both oxidant and fuel to a respective one of said entrances to said reaction zone; and a valve assembly operative to affect flows of oxidant and fuel along only a single one of said flow paths;

said burner structure including multiple mixer tubes, each of which extends along a respective one of said flow paths;

said burner structure further including an oxidant source and a housing structure defining an oxidant supply plenum commonly communicating said oxidant source with all of said mixer tubes.

10. The apparatus as defined in claim 9 wherein said valve assembly is located within said oxidant supply plenum in operative engagement with an inlet end of a single one of said mixer tubes.

11. A premix burner apparatus for heating a process chamber, said apparatus comprising:

a burner structure defining a premix reaction zone configured to communicate with the process chamber, said burner structure further defining a plurality of separate entrances to said reaction zone, and a corresponding plurality of separate premix flow paths, each of which is configured to direct both oxidant and fuel to a respective one of said separate entrances to said reaction zone; and a firing rate control system operative to control flows of oxidant and fuel along at least one of said flow paths separately from flows of oxidant and fuel along at least one other of said flow paths;

said firing rate control system being further operative to interrupt a combined flow of oxidant and fuel along at least one of said flow paths while oxidant and fuel continue to flow along at least one other of said flow paths;

said firing rate control system including a plurality of separately shiftable valve assemblies, each of which is shiftable between a closed condition blocking a combined flow of oxidant and fuel along a single corresponding one of said flow paths and an open condition not blocking said flow;

said firing rate control system further including a controller operative to shift a selected group of said valve assemblies into or out of their closed conditions simultaneously;

said controller having a mode of operation comprising consecutive cycles in which different selected groups of said valve assemblies are shifted into or out of their closed conditions simultaneously.

12. A method of operating a premix burner apparatus for heating a process chamber, the apparatus including a burner structure defining a premix reaction zone configured to communicate with the process chamber, the burner structure further defining a plurality of separate entrances to the reaction zone, and a corresponding plurality of separate premix flow paths, each of which is configured to direct both oxidant and fuel to a respective one of the separate entrances to the reaction zone, said method comprising:

controlling flows of oxidant and fuel along at least one of said flow paths separately from flows of oxidant and fuel along at least one other of said flow paths, said controlling step comprising interrupting a combined flow of oxidant and fuel along at least one of said flow paths while oxidant and fuel continue to flow along at least one other of said flow paths;

said controlling step further comprising consecutive cycles in which a combined flow of oxidant and fuel is interrupted along only one of said flow paths.

13. The method as defined in claim 12 wherein a combined flow of oxidant and fuel is interrupted along a different one of the flow paths in each of said consecutive cycles.

14. A method of operating a premix burner apparatus for heating a process chamber, the apparatus including a burner structure defining a premix reaction zone configured to communicate with the process chamber, the burner structure further defining a plurality of separate entrances to the reaction zone, and a corresponding plurality of separate premix flow paths, each of which is configured to direct both oxidant and fuel to a respective one of the separate entrances to the reaction zone, said method comprising:

controlling flows of oxidant and fuel along at least one of said flow paths separately from flows of oxidant and fuel along at least one other of said flow paths, said controlling step comprising interrupting a combined flow of oxidant and fuel along a selected group of said flow paths simultaneously;

combined flows of oxidant and fuel are interrupted along a different selected group of said flow paths in each of said consecutive cycles.

* * * * *